US010791602B2

(12) United States Patent
Nietfeld

(10) Patent No.: US 10,791,602 B2
(45) Date of Patent: Sep. 29, 2020

(54) METHOD AND DEVICE FOR ADJUSTING A VOLTAGE SUPPLY DEVICE FOR A MULTICHANNEL LED CONTROL AND POWER SUPPLY DEVICE

(71) Applicant: Hella GmbH & Co. KGaA, Lippstadt (DE)

(72) Inventor: Dieter Nietfeld, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/511,850

(22) Filed: Jul. 15, 2019

(65) Prior Publication Data

US 2020/0022231 A1 Jan. 16, 2020

(30) Foreign Application Priority Data

Jul. 13, 2018 (DE) ..... 10 2018 117 021

(51) Int. Cl.
*H05B 33/00* (2006.01)
*H05B 45/37* (2020.01)
*H05B 45/00* (2020.01)

(52) U.S. Cl.
CPC ..... *H05B 45/37* (2020.01); *H05B 45/00* (2020.01)

(58) Field of Classification Search
CPC ..... H05B 37/0263; H05B 37/0245; H05B 33/0815; H05B 33/083; H05B 33/0863; H05B 33/089; H05B 37/0272; H05B 33/08; H05B 33/0803; H05B 33/0827; H05B 33/0866; H05B 37/02; H05B 33/0854; H05B 37/0209; H05B 37/0227
See application file for complete search history.

(56) References Cited

U.S. PATENT DOCUMENTS

2007/0182672 A1 8/2007 Hoppenbrouwers et al.
2009/0026981 A1 1/2009 Li Volsi
2009/0309817 A1 12/2009 Park
2017/0127493 A1* 5/2017 Woytowitz ..... H05B 33/0863

FOREIGN PATENT DOCUMENTS

DE 202017006830 U1 8/2018

* cited by examiner

*Primary Examiner* — Monica C King
(74) *Attorney, Agent, or Firm* — Muncy, Geissler, Olds & Lowe, P.C.

(57) ABSTRACT

A method for adjusting a voltage supply device for a multichannel LED control and power supply device having a determination of a number of LEDs that are connected to a multichannel LED control and power supply device or are a part of this device and that are switched on and supplied with current by the multichannel LED control and power supply device at a point in time, and a setting of a voltage with which the multichannel LED control and power supply device is supplied as a function of the number of LEDs determined that are switched on and supplied with current.

3 Claims, 1 Drawing Sheet

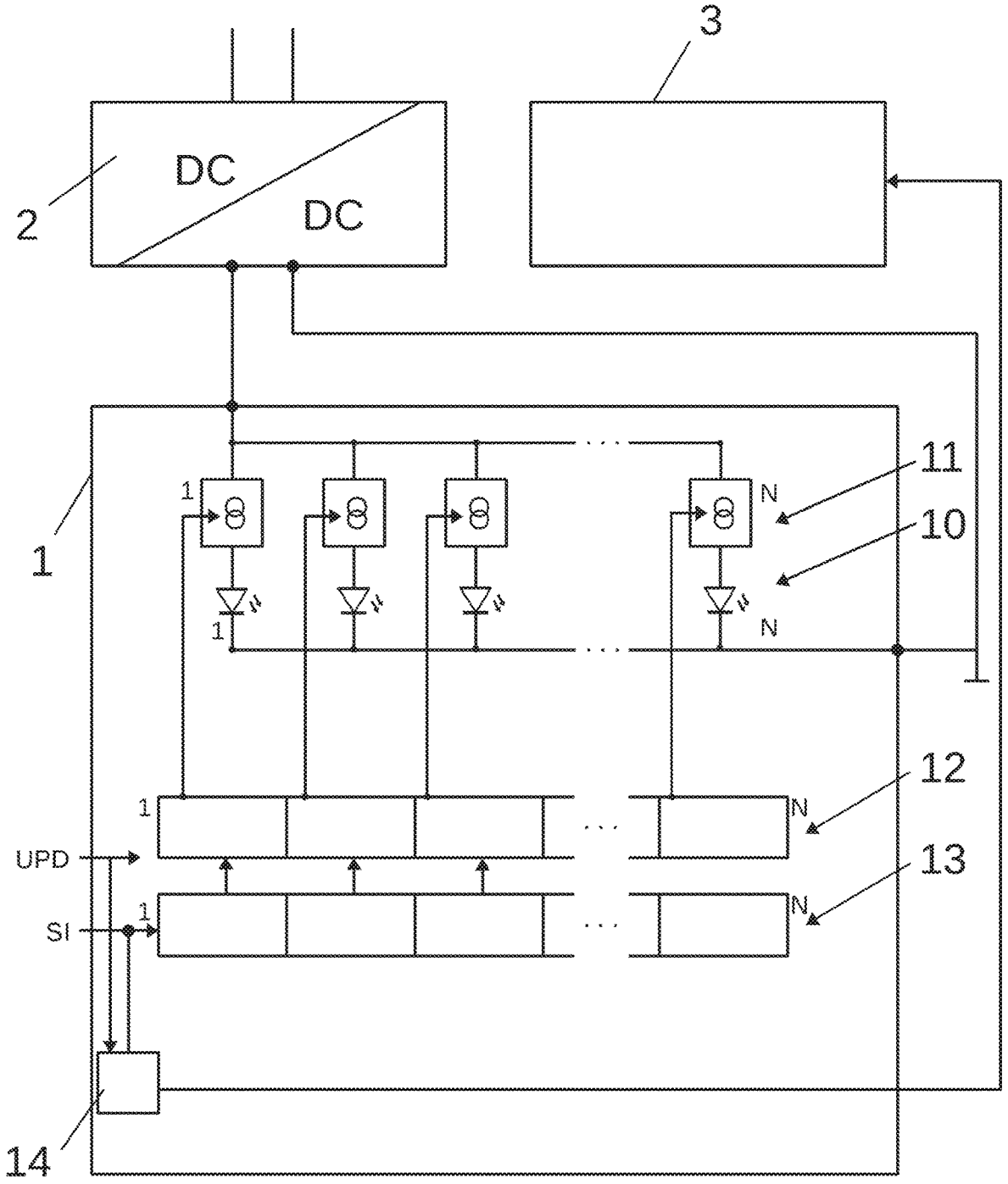
3
DC
DC
2
1
11
10
1
N
1
N
12
13
UPD
SI
1
N
1
N
14

METHOD AND DEVICE FOR ADJUSTING A VOLTAGE SUPPLY DEVICE FOR A MULTICHANNEL LED CONTROL AND POWER SUPPLY DEVICE

This nonprovisional application claims priority under 35 U.S.C. § 119(a) to German Patent Application No. 10 2018 117 021.1, which was filed in Germany on Jul. 13, 2018, and which is herein incorporated by reference

BACKGROUND OF THE INVENTION

Field of the Invention

The present invention relates to a method for adjusting a voltage supply device for a multichannel LED control and power supply device.

Description of the Background Art

Connected to multichannel LED control and power supply devices are a multiplicity of LEDs, which can be supplied individually with current by the multichannel LED control and power supply device, and in particular can also be switched on and off individually. At present, devices for powering 1024 LEDs are known. However, devices are already planned for powering up to 100,000 LEDs, which are arranged in an integrated circuit.

The term "multichannel" can mean that multiple (at least two) channels/branches, each with at least one LED, are driven, with the LED branches being wired in parallel with one another. Preferably, the multichannel LED control and power supply device according to the invention concerns an LED arrangement of this nature, in which exactly one LED is arranged in each of the parallel-connected branches.

The forward voltage of the LEDs is, for example, 3.2 V as a rule.

The current sources of the multichannel LED control and power supply device require a voltage of, for example, 0.5 volts in order to regulate the current. Since variations of individual LEDs are sometimes possible, a voltage of 0.6 V is assumed in the example.

A voltage drop between the output of the voltage supply device and an input of the multichannel LED control and power supply device can be 1.54 V, for example. It results from the current and the line and transition resistances between the output and the input. The current depends on the current consumption of the LEDs.

The LEDs are supplied by the multichannel LED control and power supply device with a current of 15 mA, for example. In the case of 1024 LEDs or current sources, for example, the value of the voltage drop between the output of the voltage supply device and an input of the multichannel LED control and power supply device thus is obtained from 1.54 V=1024*15 mA*0.1 ohm, with an assumed total line and transition resistance between the voltage supply and the input of the multichannel LED control and power supply device of 0.1 ohm.

In the example, the voltage supply device must therefore provide a voltage of 3.2 V+0.6 V+1.54 V at the output so that all 1024 LEDs can be supplied with sufficient current.

The current demand of the multichannel LED control and power supply device for powering the LEDs is reduced when fewer LEDs are switched on. This has the result that the power not drawn by the switched-off LEDs is converted into power dissipation, which is to say heat, in the multichannel LED control and power supply device, and in particular in the current sources that the switched-off LEDs are connected to.

The heat is generated in the multichannel LED control and power supply device, and must be removed in order to avoid damage to the multichannel LED control and power supply device caused by heating.

SUMMARY OF THE INVENTION

It is therefore an object of the present invention to avoid heating of the multichannel LED control and power supply device when not all of the LEDs to be powered by the device are switched on.

This problem is solved according to an exemplary embodiment of the invention by a method for adjusting a voltage supply device for a multichannel LED control and power supply device comprising a determination of a number of LEDs that are connected to a multichannel LED control and power supply device or are a part of this device and that are switched on and supplied with current by the multichannel LED control and power supply device at a point in time, and a setting of a voltage with which the multichannel LED control and power supply device is supplied as a function of the number of LEDs determined.

According to the invention, a counter can be provided that is incremented when an LED is switched on and is decremented when an LED is switched off, or is only incremented or decremented, wherein the counter is reset to an initial value before every cycle, for example to the value zero.

The method according to the invention can use a register. Which LEDs should be switched on in a next time slot can be specified in the register. During filling of the register, a counter that is first initialized to an initial value can be incremented when a register value is entered that causes an LED to be switched on in the next time slot. The initial value preferably is zero. At the beginning of the next time slot, the voltage for supplying the multichannel LED control and power supply device can then be set as a function of the value of the counter.

The voltage $V_A$ that is provided at an output of the voltage supply device to supply the multichannel LED control and power supply device can be determined as follows when the number of LEDS that are switched on is known:

$$V_A = V_{Fmax} + V_Q + n*I*R_L$$

wherein

- $V_A$: is the voltage at the output of the voltage supply device,
- $V_{Fmax}$: is the maximum forward voltage of the LEDs connected to the multichannel LED control and power supply device,
- $V_Q$: is the voltage required by the multichannel LED control and power supply device for setting the output currents for the LEDs,
- n: is the number of LEDs that are switched on,
- I: is the current of an individual LED, and
- $R_L$: is the ohmic resistance between the output of the voltage supply device and the input of the multichannel LED control and power supply device.

The object of the invention is also attained by an adjuster to adjust a voltage supply device for a multichannel LED control and power supply device. The adjuster has a counter input, a counter output, and a counter, wherein the adjuster is configured such that a signal can be applied at the counter input that supplies a pulse when an LED is switched on or off, wherein the counter is incremented upon a switch-on pulse and decremented upon a switch-off pulse, and wherein the value of the counter can be read out by means of the counter output.

The adjuster according to the invention for adjusting a voltage supply device can have a strobe signal input in addition to the counter input, the counter output, and the counter. The adjuster can then be configured such that a signal can be applied at the counter input that provides a pulse for an LED that is to be switched on, wherein the counter increments upon a pulse at the counter input and wherein the value of the counter can be read out by means of the counter output once a strobe signal is present at the strobe input. Together with the strobe signal, the counter can be reset to an initial value after the value is read out.

A register can be provided between the counter and the counter output into which the counter state is transferred when a strobe signal is applied. The counter state can then be retrieved from this counter register through the counter output of the adjuster.

A control unit according to the invention for an LED headlight with a multichannel LED control and power supply device and a voltage supply device for the multichannel LED control and power supply device can have an adjuster according to the invention for adjusting a voltage supply device. The adjuster according to the invention can be integrated into a multichannel LED control and power supply device or can be a standalone part of an arrangement according to the invention. The adjuster according to the invention can also be part of a microcontroller that interacts with the multichannel LED control and power supply device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which are given by way of illustration only, and thus, are not limitive of the present invention, and wherein the sole FIGURE is a block diagram illustrating and exemplary arrangement according to the invention.

DETAILED DESCRIPTION

The FIGURE illustrates a greatly simplified block diagram of an arrangement including a multichannel LED control and power supply device, a voltage supply device for the multichannel LED control and power supply device, and a control unit for the voltage supply device.

The arrangement according to the invention has a multichannel LED control and power supply device 1, a voltage supply device 2 for the multichannel LED control and power supply device 1, and a control unit 3 for the voltage supply device 2.

The voltage supply device 2 can be connected to a DC network, for example to a vehicle electrical system of a motor vehicle. The voltage supply device 2 converts a primary DC voltage at an input side into a secondary DC voltage at the output side. A desired value for the secondary DC voltage is specified by the control unit 3.

The secondary DC voltage supplies the multichannel LED control and power supply device 1. This has a number N of LEDs 10 that are supplied with current by N current sources 11. The current sources 11 can be switched on and off in order to switch the connected LEDs 10 on and off.

The switching state of the LEDs 10 or of the current sources 11 is specified by a first register 12. Whether an LED 10 is switched on or not is specified in the first register 12.

The values in the first register 12 are specified from the outside. To enter the values into the first register 12, a second register—a shift register 13—is used initially. From the outside, the desired switching states are entered serially into the shift register 13 through an input SI of the multichannel LED control and power supply device 1. Once N desired switching states have been entered into the shift register 13, the content of the shift register 13 is transferred into the first register 12 by means of a signal at an input UPD of the multichannel LED control and power supply device 1, which has the immediate result that the current sources 11 are adjusted according to the desired switching states specified in the first register 12.

At the same time as the transfer of the register content into the first register, the voltage provided by the voltage supply device 2 to supply the multichannel LED control and power supply device 1 is matched to the power requirement of the current sources. To this end, the control unit 3 of the voltage supply device 2 receives a signal from the multichannel LED control and power supply device 1 that indicates how many LEDs 10 are switched on. The signal is provided by a counter 14.

Upon initialization of the shift register 13, the counter 14 counts how many LEDs 10 should be switched on. For every LED 10 that should be switched on, the counter is correspondingly incremented from zero. Once the signal for transferring the register content from the shift register 13 into the first register 12 is present at the input UPD, the counter state is transmitted to the control unit 3 by the counter 14, and the counter state is reset to zero.

The invention being thus described, it will be obvious that the same may be varied in many ways. Such variations are not to be regarded as a departure from the spirit and scope of the invention, and all such modifications as would be obvious to one skilled in the art are to be included within the scope of the following claims:

What is claimed is:

1. A method for adjusting a voltage supply device for a multichannel LED control and power supply device, the method comprising:

determining a number of LEDs that are connected to a multichannel LED control and power supply device or are a part of this device and that are switched on and supplied with current by the multichannel LED control and power supply device at a point in time; and setting a voltage with which the multichannel LED control and power supply device is supplied as a function of the number of LEDs determined that are switched on and supplied with current, wherein switching states of the LEDs to be switched on or off in a next time slot are entered into a register and during entering of the switching states into the register, a counter counts how many of the LEDs are to be switched on, wherein once entry of the switching states into the register is completed, the switching states of the register are transferred to another register and current sources are then adjusted according to the switching states, and wherein at a same time as the switching states being transferred from the register to the another register, a voltage for supplying the multichannel LED control and power supply device is set as a function of a value of the counter due to a signal provided by the counter.

2. The method according to claim 1, wherein the counter is incremented when an LED is switched on and is decremented when an LED is switched off, or is only incremented from an initial value when an LED is switched on, or is only decremented from an initial value when an LED is switched off.

3. The method according to claim 1, wherein the voltage $V_A$ that is provided at an output of the voltage supply device to supply the multichannel LED control and power supply device is determined as follows:

$$V_A = V_{Fmax} + V_Q + n*I*R_L$$

wherein $V_A$: is the voltage at the output of the voltage supply device, $V_{Fmax}$: is the maximum forward voltage of all the LEDs connected to the multichannel LED control and power supply device, $V_Q$: is the voltage required by the multichannel LED control and power supply device for setting the output currents for the LEDs, n: is the number of LEDs that are switched on, I: is the current of an individual LED, and $R_L$: is the ohmic resistance between the output of the voltage supply device and the input of the multichannel LED control and power supply device.

* * * * *